US005588375A

United States Patent [19]

Cotterill

[11] Patent Number: 5,588,375

[45] Date of Patent: Dec. 31, 1996

[54] MOUNTING TRACK

[76] Inventor: Michael J. Cotterill, Lot 5, Tugalong Road, Canyonleigh N.S.W. 2577, Australia

[21] Appl. No.: 338,494

[22] PCT Filed: May 19, 1993

[86] PCT No.: PCT/AU93/00231

§ 371 Date: Nov. 17, 1994

§ 102(e) Date: Nov. 17, 1994

[87] PCT Pub. No.: WO93/22950

PCT Pub. Date: Nov. 25, 1993

[30] Foreign Application Priority Data

May 19, 1992 [AU] Australia ..... PL2522
Aug. 7, 1992 [AU] Australia ..... PL4023

[51] Int. Cl.[6] ..... A47B 11/00

[52] U.S. Cl. ..... 108/102; 108/143

[58] Field of Search ..... 312/223.3, 208.1; 108/102, 105, 143, 137, 138

[56] References Cited

U.S. PATENT DOCUMENTS

| | | | |
|---|---|---|---|
| 2,161,323 | 6/1939 | Stephenson . | |
| 2,251,198 | 7/1941 | Oneal . | |
| 2,656,234 | 10/1953 | Koch . | |
| 2,919,966 | 1/1960 | Preston . | |
| 2,937,765 | 5/1960 | Shank | 108/143 |
| 4,189,953 | 2/1980 | Volk | 108/143 |
| 4,644,875 | 2/1987 | Watt | 108/143 |
| 4,688,862 | 8/1987 | Fowler et al. . | |

FOREIGN PATENT DOCUMENTS

| | | |
|---|---|---|
| 241256 | 10/1962 | Australia . |
| 264563 | 1/1966 | Australia . |
| 271581 | 11/1966 | Australia . |
| 65366/65 | 6/1971 | Australia . |
| 34550/68 | 3/1972 | Australia . |
| 72014/81 | 6/1980 | Australia . |
| 75700/87 | 1/1988 | Australia . |
| 19015/88 | 1/1989 | Australia . |
| 21786/88 | 3/1989 | Australia . |
| 38179/89 | 1/1990 | Australia . |
| 65578/90 | 5/1991 | Australia . |
| PCT/AU90/00595 | 8/1991 | WIPO . |

*Primary Examiner*—Peter R. Brown
*Assistant Examiner*—Gerald A. Anderson
*Attorney, Agent, or Firm*—Pearne, Gordon, McCoy & Granger

[57] ABSTRACT

A workstation (1) includes two transversely spaced apart and opposed mounting tracks (2) connecting a VDU support shelf (3) and a keyboard support (4) for relative longitudinal movement. Each track (2) includes a longitudinally extending body (5) for abutting the bottom surface (6) of support shelf (3) Tracks (2) are held in fixed relation with surface (6) by a plurality of spaced apart counter sunk screws (7) which are received by complementary apertures (8 ) in body (5). First and second transverse arms (9,10) extend from body (5) and have respective opposed substantially parallel first and second engagement surfaces (11,12) which in combination with body (5) define an open ended channel (13) for retaining a complementary support formation in the form of a support bracket (14). The free end (15) of arm (9) extends beyond the free end (16) of arm (10) and includes a peripherally depending lip (18). The lip partly closes channel (13) adjacent free ends (15,16) to restrain relative transverse movement between support bracket and surface (14,2) respectively.

16 Claims, 8 Drawing Sheets

MOUNTING TRACK

TECHNICAL FIELD

The present invention relates to a mounting track and in particular to a workstation incorporating that mounting track.

The invention has been developed primarily for use with adjustable computer platforms and desks and will be described hereinafter with reference to that application. However, it will be appreciated that the invention is not limited to that particular field of use and is also suitable for shelving, draws and other structures including slidably mounted components.

BACKGROUND ART

Ergonomic studies relating to keyboard and terminal positioning have lead to the development of a great number of adjustable workstations and desks. Although such stations tend to provide a reasonable degree of relative vertical movement between surfaces respectively supporting a keyboard and a monitor or VDU, there has generally been a deficiency in the availability of relative horizontal movement between these two surfaces.

In order to compensate for this deficiency new workstations are being produced, and old workstations retrofitted with mechanisms which allow such relative horizontal movement.

The prior art workstations generally include a height adjustment mechanism extending between the two work surfaces. In order to allow relative horizontal movement between these surfaces the adjustment mechanism must be disconnected from one of the surfaces to allow the interpositioning of an adaptor therebetween.

Such adaptors include a metal plate for fixed abutment with the bottom of one of the surfaces. Integrally projecting from the plate are a pair of opposed formations spaced apart for slidably engaging an existing complementary formation on the height adjustment mechanism. Consequently, the adaptor must be custom made for each particular application. Furthermore, the formations on both the plate and adjustment mechanism are prone to wear and distortion. More particularly, the formations on the adjustment mechanism are not designed for such mounting which can lead to failure of the formations.

Those workstations produced with horizontal adjustment means necessitate strict quality control during manufacturing due to the tolerances required to ensure that jamming does not occur. However, only small amounts of use causes wear which is sufficient to render such a workstation unsatisfactory.

DISCLOSURE OF THE INVENTION

It is an object of the present invention, at least in its preferred embodiment, to overcome or substantially ameliorate at least some of these deficiencies of the prior art.

According to a first aspect of the present invention there is provided a mounting track for connecting a first and a second structure for relative longitudinal movement, the track including a longitudinally extending body for abutting the first structure and first and second transverse arms extending from the body and having respective opposed substantially parallel first and second engagement surfaces which, in combination with the body, define an open ended channel for retaining a complementary support formation extending from the second structure, wherein the support formation bears on one of said first and second engagement surfaces, wherein the support formation bears on one of said first and second engagement surfaces, the free end of the first arm both extending beyond the free end of the second arm and including a peripherally depending lip for partly closing the channel and restraining transverse movement of the support formation.

Preferably, at least one of the first and second engagement surfaces includes a plurality of engagement formations for facilitating slidable progression of the support formation along the engagement surface. More preferably, the engagement formations extend longitudinally along the length of the engagement surface and take the form of a plurality of semi circular detents. Alternatively, the engagement formations are longitudinally extending ridges transversely spaced apart across the engagement surfaces.

Preferably also, the lip extends substantially perpendicularly to the plane of the second engagement surface and defines a third engagement surface extending from the first engagement surface.

According to a second aspect of the invention there is provided a workstation including:

two generally horizontal support members;

a linkage mechanism for maintaining a predetermined vertical displacement between the members;

the mechanism fixed at one end to one of the members and at the other end including at least one longitudinally extending support formation; and at least one mounting track as described above fixedly engaged to the other of the members and accepting respective support formations for longitudinal slidable engagement therewith.

Preferably, the mechanism is adjustable for allowing relative vertical movement between the members. More preferably the mechanism includes a locking device for selectively maintaining the mechanism in one of a plurality of configurations.

According to a third aspect of the invention there is provided a method for mounting a first surface to a second surface for relative longitudinal movement, the method including the steps of:

fixedly securing to the first surface in a longitudinal orientation at least one of the mounting tracks as described above; and engaging the channel of each track with a respective complementary formation extending from the second surface.

Preferably, the tracks are presented into slidable engagement with the formation before being secured to the first surface.

Preferably also, the formations are flanges associated with a height adjustment mechanism extending between the two surfaces.

In a preferred form the first and second surfaces are associated with a workstation and adapted to support a keyboard and monitor respectively.

According to a fourth aspect of the invention there is provided an adjustable keyboard support including a support bracket for mounting to a desk surface, a linkage arm hinged at a first end to the support bracket, a keyboard support retained at a second end of the linkage arm for movement between a raised and lowered configuration, and locking means extending between the support bracket and linkage arm for selectively maintaining the keyboard support in one of a plurality of predetermined dispositions wherein when said linkage arm is in the raised configuration the free end of the keyboard support is disposed closer to said surface than the fixed end of the keyboard support.

Preferably, the support bracket includes a flange for complementarily engaging a channel of a mounting track as described above. More preferably, the adjustable keyboard support includes two opposed support brackets retained within respective channels of two parallel spaced apart mounting tracks which are both attached to the desk surface.

According to a fifth aspect of the invention there is provided a mounting track for connecting a first and a second structure for relative longitudinal movement, the track including a longitudinally extending body for abutting the first structure and first and second transverse arms extending from the body and having respective opposed, substantially parallel, first and second engagement surfaces, which in combination with the body, define an open ended channel for retaining a complementary support formation extending from the second structure, and including a depending lip for partly closing the channel to restrain transverse movement of the support formation, said body including at least one bevelled aperture for cooperating with connecting means to secure said body to said first structure, wherein said connecting means includes a complementary bevelled portion for engaging said aperture and providing additional support to at least one of said arms.

According to a fifth aspect of the invention there is provided a mounting track for connecting a first and a second structure for relative longitudinal movement, the track including a longitudinally extending body for abutting the first structure and first and second transverse arms extending from the body and having respective opposed substantially parallel first and second engagement surfaces, which in combination with the body, define an open ended channel for retaining a complementary support formation extending from the second structure, and including a depending lip for partly closing the channel to restrain transverse movement of the support formation, said body including at least one bevelled aperture for cooperating with connecting means to secure said body to said first structure, wherein said connecting means includes a complementary bevelled portion for engaging said aperture and providing additional support to at least one of said arms.

Preferred embodiments of the invention will now be described, by way of example only, with reference to the accompanying drawings in which.

MODES FOR CARRYING OUT THE INVENTION

Figure 1:
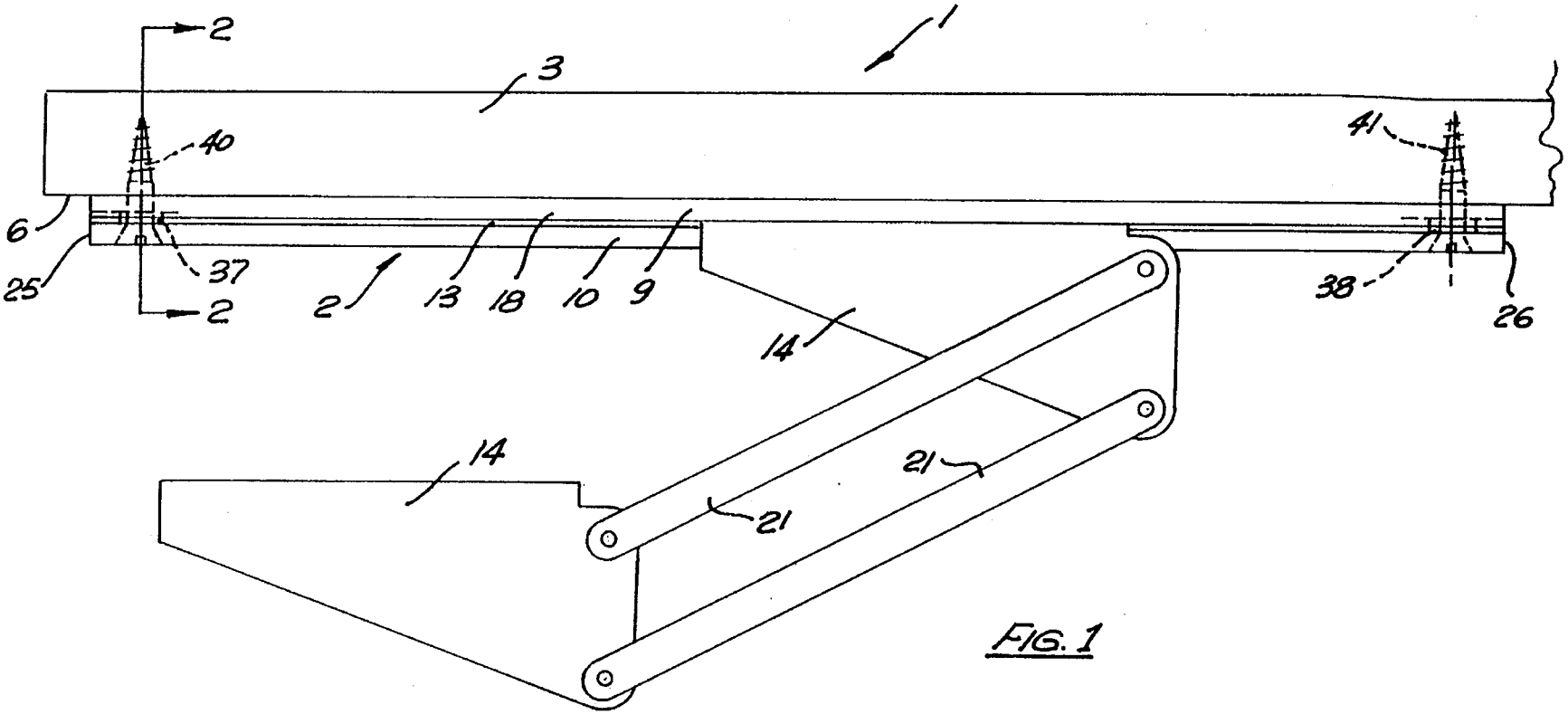
FIG. 1 is a side elevation of a workstation according to the second aspect of the invention which includes a mounting track according to the first aspect of the invention.
Figure 2:
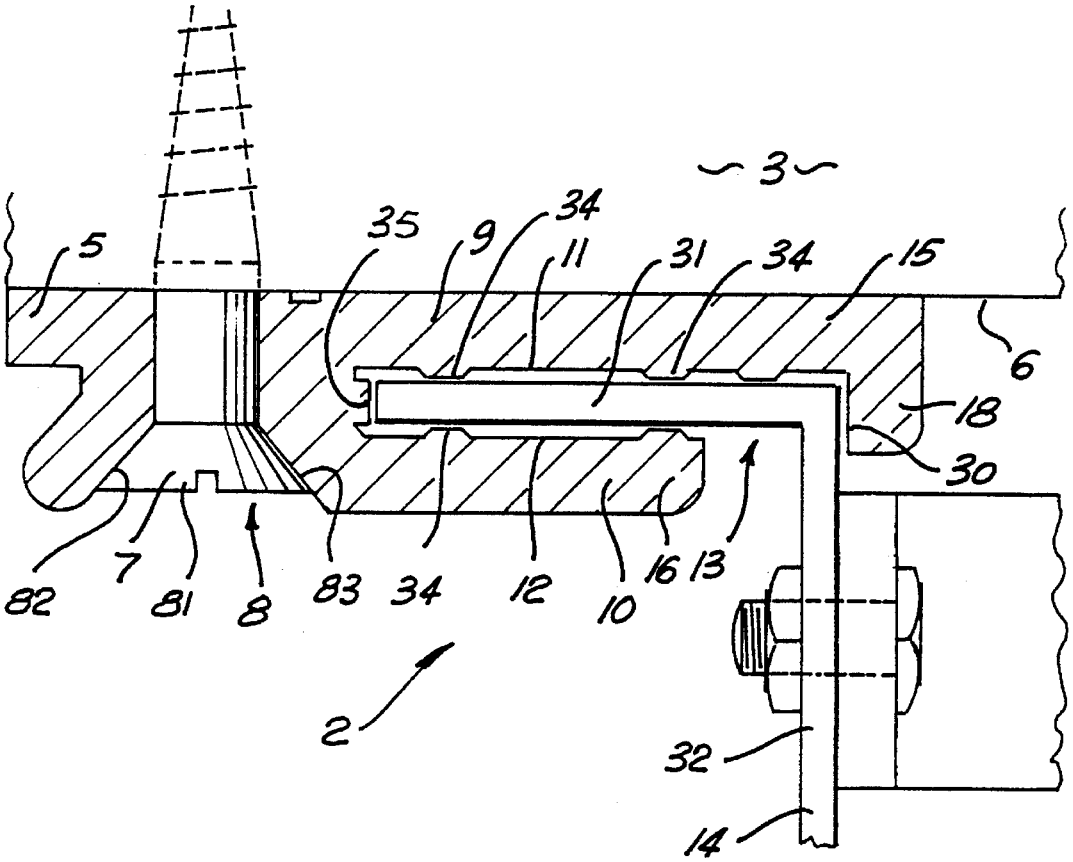
FIG. 2 is an enlarged cross sectional view taken along line 2—2 of FIG. 1.

Referring to FIGS. 1 and 2 a workstation includes two transversely spaced apart and opposed mounting tracks 2 connecting a VDU support shelf 3 and a keyboard support 4 for relative longitudinal movement. Each track 2 includes a longitudinally extending body 5 for abutting the bottom surface 6 of support shelf 3. Tracks 2 are held in fixed relation with surface 6 by a plurality of spaced apart counter sunk screws 7 which are received by complementary apertures 8 in body 5. Additional apertures 8 are included for high load applications. For example, a longitudinal spacing between screws of 95 mm provides tracks 2 with a load bearing capacity of approximately 90 kg.

First and second transverse arms 9 and 10 extend from body 5 and have respective opposed substantially parallel first and second engagement surfaces 11 and 12 which in combination with body 5 define an open ended channel 13 for retaining a complementary support formation in the form of a support bracket 14. The free end 15 of arm 9 extends beyond the free end 16 of arm 10 and includes a peripherally depending lip 18. The lip partly closes channel 13 adjacent free ends 15 and 16 to restrain relative transverse movement between support bracket and surface 14 and 2 respectively. Workstation 1 includes two opposed tracks 2 for further restraining such transverse movement.

Referring in particular to FIG. 1, bracket 14 rotatably supports four parallel arms 21 which extend to rotatably engage keyboard support 4 to allow vertical pantographic movement of support 4 with respect to shelf 3. As a result, shelf 3 and support 4 are able to be positioned both longitudinally, which in this case is horizontally, and vertically with respect to each other. This degree of freedom allows a user to assume an ergonomically correct posture to ensure both comfortable working conditions and a reduction in the likelihood of repetitive strain injury.

Each track 2 is formed from a continuous length of extruded plastic such as PVC or a composite material and extends between respective first ends 25 and second ends 26 along surface 6 of shelf 3. In less preferred embodiments a plurality of separate adjacent spaced apart sections of track 2 are used, which in combination define a path for horizontal movement of bracket 14 along the track.

As best illustrated in FIG. 2, lip 18 extends substantially perpendicularly to arm 9 from free end 15 and toward the plane defined by engagement surface 12. The resultant downwardly depending engagement surface 30, in combination with body 5, substantially prevents transverse movement of horizontal flange 31 within track 2. Consequently, bracket 14 is also restrained from transverse movement.

Lip 18 also functions to retain flange 31 within channel 13 when any deformation of bracket 14 or arms 9 and 10 occurs. That is, an excessive load on support 4 tends to deform flange 31, either resiliently or otherwise, from a substantially perpendicular configuration with respect to depending plate 32. Alternatively, the load could deform arm 10 such that it extends away from arm 9. In both circumstances the combination of body 1 and surface 30 will continue to substantially prevent any transverse movement.

The presence of lip 18 makes track 2 much more resistant to wear from any transverse forces. This feature is advantageous because keyboard support 4 is in most circumstances either pushed or pulled from a corner and as such transverse components of force must be accommodated.

The engagement surfaces 11 and 12 both include a plurality of longitudinally extending, transversely spaced apart ridges 34 across the width thereof. These ridges facilitate slidable engagement of flange 31 within channel 13. Body 5 also includes a ridge 35 for similar reasons.

In less preferred embodiments only engagement surface 12 includes ridges 34, and an even less preferred embodiment does not include any ridges.

Ridges 34 in some embodiments take the form of a plurality of rows of semi circular detents linearly arranged and extending longitudinally along track 2. Preferably, the spacing between these detents is approximately equal to the diameter of the detents, however, other spacings are also possible.

In some embodiments surfaces 11 and 12 are coated with a material for providing a low resistance to longitudinal movement of bracket 14 within channel 13. Such coatings include silicon based sprays which are particularly suitable for application to PVC tracks.

Both lip 18 and ridges 34 and 35 contribute to the improved workstation as described above. Any transverse movement of flange 31 is restrained by each track, and as such the invention allows for a substantial reduction in the tolerances required in production of track 2.

Located at or adjacent to ends 25 and 26 are abutments 37 and 38 which limit the longitudinal movement of support 4 along track 2. In this embodiment the abutments are in the form of rubber washers retained by respective screws 40 and 41. Abutments 37 and 38 are of a height less than that of channel 13 and as such when keyboard support 4 is advanced to progress flange 31 to the limit of the permitted horizontal excursion, flange 31 engages abutment 37 or 38 in an interference fit to firstly have a braking effect on support 4 and subsequently releasably retain support 4 in that configuration. If required, a further locking device is included with workstation 1 to selectively prevent any longitudinal movement between shelf 3 and support 4 at any relative disposition therebetween.

In other embodiments one or both of tracks 2 include at each of their ends at least one detent projecting inwardly from surface 11 or 12. As flange 31 is progressed into engagement with these detents, any further movement will be restrained due to the increased frictional loading. The detents are able to be formed by punching or stamping the outside surface of arms 9 or 10 at appropriate distances from the ends of tracks 2. However, other methods of producing the detents are available, for example, in some embodiments the detents are integrally formed with the tracks.

Figure 3:
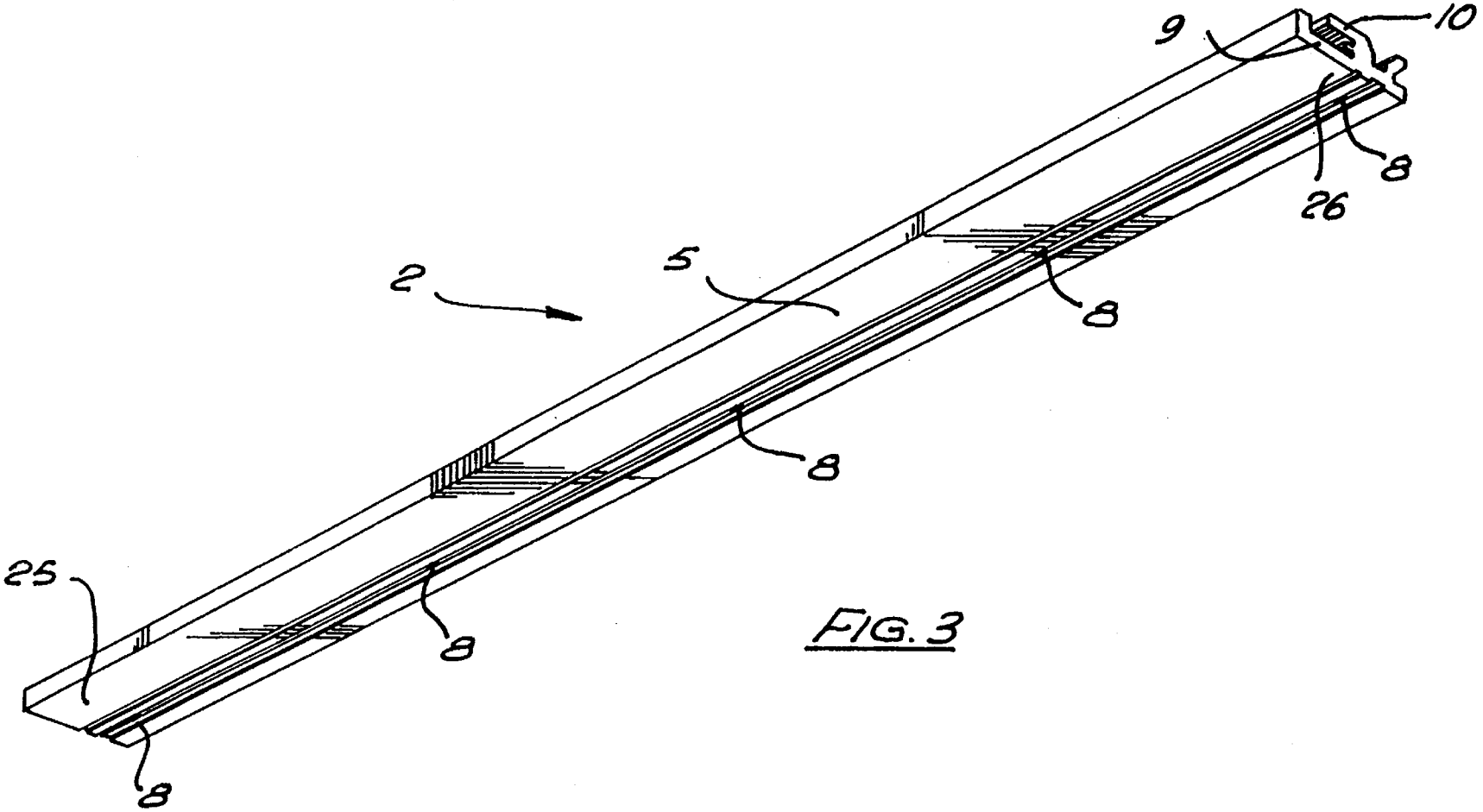
FIG. 3 is ea perspective view of an alternative mounting track.
Figure 5:
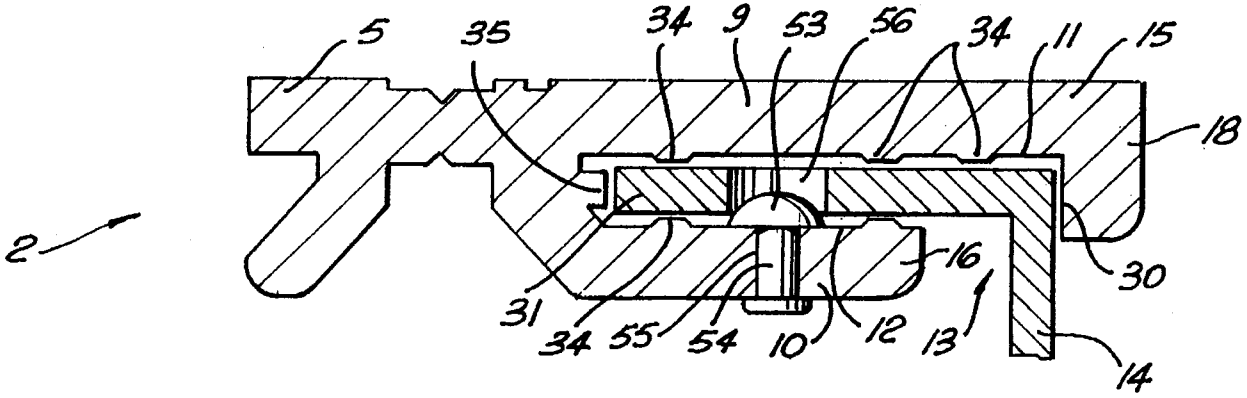
FIG. 5 is a further enlarged cross sectional view taken along line 5—5 of FIG. 4.
Figure 4:
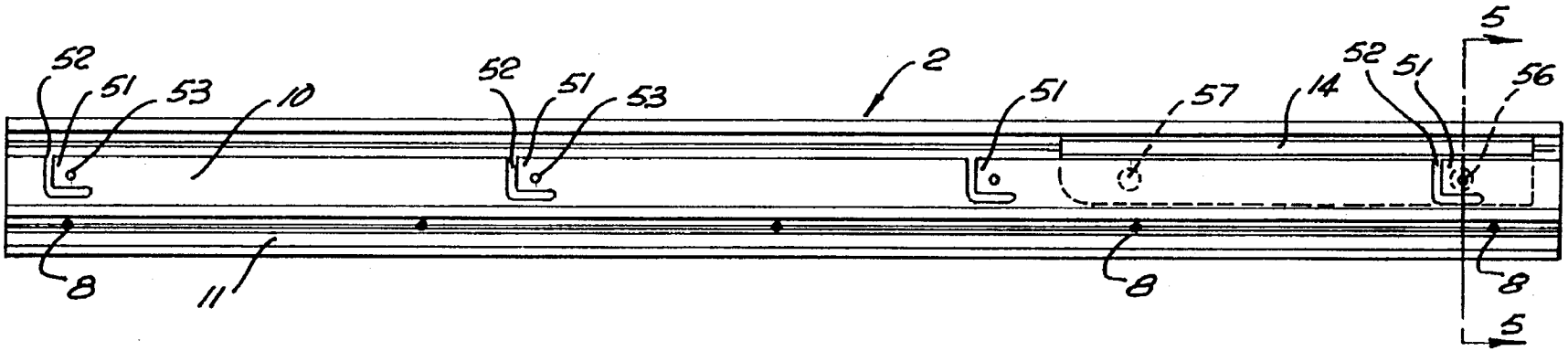
FIG. 4 is an underside view of the track of FIG. 3.

Referring in particular to FIGS. 3, 4 and 5, where corresponding features are denoted by corresponding reference numerals, track 2 includes additional locking means in the form of an integral locking tabs 51 which are equally longitudinally spaced apart on arm 10.

Tabs 51 are formed by creating an appropriate number of L-shaped slots 52 in arm 10. The transverse and longitudinal extent of the perpendicular portions of the slots determine the resultant flexibility of the respective tabs. For example, those tabs disposed on opposite ends of track 2 are, in some applications, of a less flexible nature than the intermediate tabs.

Disposed intermediate each tab 51 are respective semi spherical nylon headed catches 53. These catches also each include a stem 54 which is engaged in an interface fit with a complementary aperture 55 in tab 51. The interference fit can be effected by riveting or the like.

In this particular embodiment support bracket 14 includes at least one, and preferably two spaced apart locking eyelets 56 and 57 disposed in flange 31. Consequently, and as best illustrated in FIG. 5, catches 53 are able to selectively progress into eyelets 56 to positively locate support 14 within channel 13.

In use, support 14 can be progressed between locked positions, as required. This operation will be described with reference to the configuration of FIG. 4, where eyelet 56 is engaged with the endmost catch 53. Although the interengagement between eyelet 56 and catch 53 will prevent longitudinal movement of support 14 when influenced by small disturbances, the application of a modest longitudinal force will cause flange 31 to sufficiently engage catch 53 and by way of the resilient tab 51, lever the catch from with the eyelet. The resistance to the longitudinal progression is subsequently reduced and support 14 is essentially unrestrained to move along channel 13. The support 14 will continue its progression until either of eyelets 56 or 57 are located adjacent a catch, whereby the resilient nature of the respective tab 51 will ensure a subsequent locking interengagement.

The number of eyelets and/or tabs used can be varied as required. Additionally, a further locking device can be used which selectively prevents tabs 51 from being deformed from the locked configuration.

The effective resistance of tabs 51 to deformation is also dependant upon the displacement of catches 53 along tab 51. If the catch is disposed further toward the free end of the tab, less force will be required to effect withdrawal of catch from an eyelet due to the additional leverage available.

In other embodiments tabs 51 are included in arm 9 or both arm 9 and arm 10.

It is preferred that body 5 of track 2 is held in abutment with a surface by way of countersunk screws. Referring in particular to FIG. 2 a preferred screw 7 includes a bevelled head 81 which allows a more satisfactory support arrangement for arm 10. Screw 7 includes a bevelled head 81 which, in use, is engaged against complementarily inclined walls 82 and 83 of body 5. The screw further strengthens body 5 and provides additional support to arm 10 as head 81 extends downwardly and outwardly. Advantageously, track 2 is configured such that screw 7 is in close proximity to the peripheral edge of flange 31 to further the above mentioned effect.

As the spacing between adjacent screws 7 is decreased the load bearing capabilities of track 2 increases. Consequently, in circumstances where a pre-existing track is to be subject to heavier loads, the only required alteration is the use of a greater number of screws 7 appropriately installed in respective apertures 8 intermediate existing apertures. A workstation initially constructed for a particular load can be easily upgraded.

In an alternative mounting track (not shown), walls 82 and 83 or configured for complementary receiving a non-bevelled screw head. Although track 2 can be suitably configured for use with such screws, it will be appreciated that the bevelled screw 7 is more effective as it exerts a radially extending force which prevents deformation of arm 10 and body 5.

If bevel headed screws are not available, an insert (not illustrated) can be provided which is shaped similarly to head 81 of screw 7 and includes suitable apertures therethrough for accepting non-beveled screws. These inserts are abutted against walls 81 and 82 and may include a number of apertures. This configuration provides a superior strength to body 5 than non-beveled screws.

Figure 6:
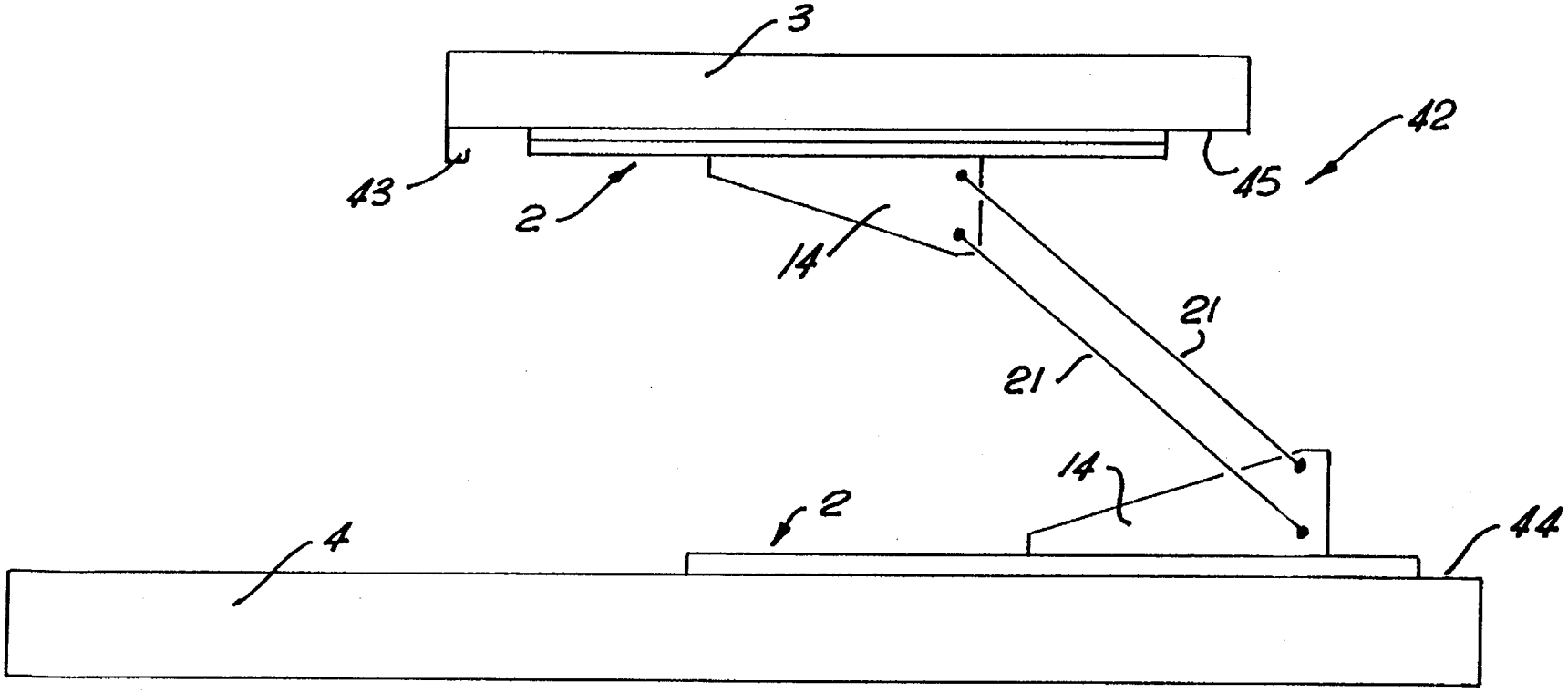
FIG. 6 is an alternative embodiment of the workstation of FIG. 1.

Referring to FIG. 6, where corresponding features are denoted with corresponding reference numerals, an alternative workstation 42 includes a fixed keyboard support 4 and a longitudinally movable support shelf 3. In this embodiment two sets of tracks 2 are used. One in an inverted configuration and abutted against a top surface 44 of support 4 and the other on the underside 45 of shelf 3. This allows the amount of available relative horizontal movement to be doubled. The advantages conferred by the use of tracks 2 apply equally as has been described above.

Support 4 includes a centrally mounted handle 43 to offer a user a convenient gripping location when moving support 4. Many other handles, notches or pads are also available.

Figure 7:
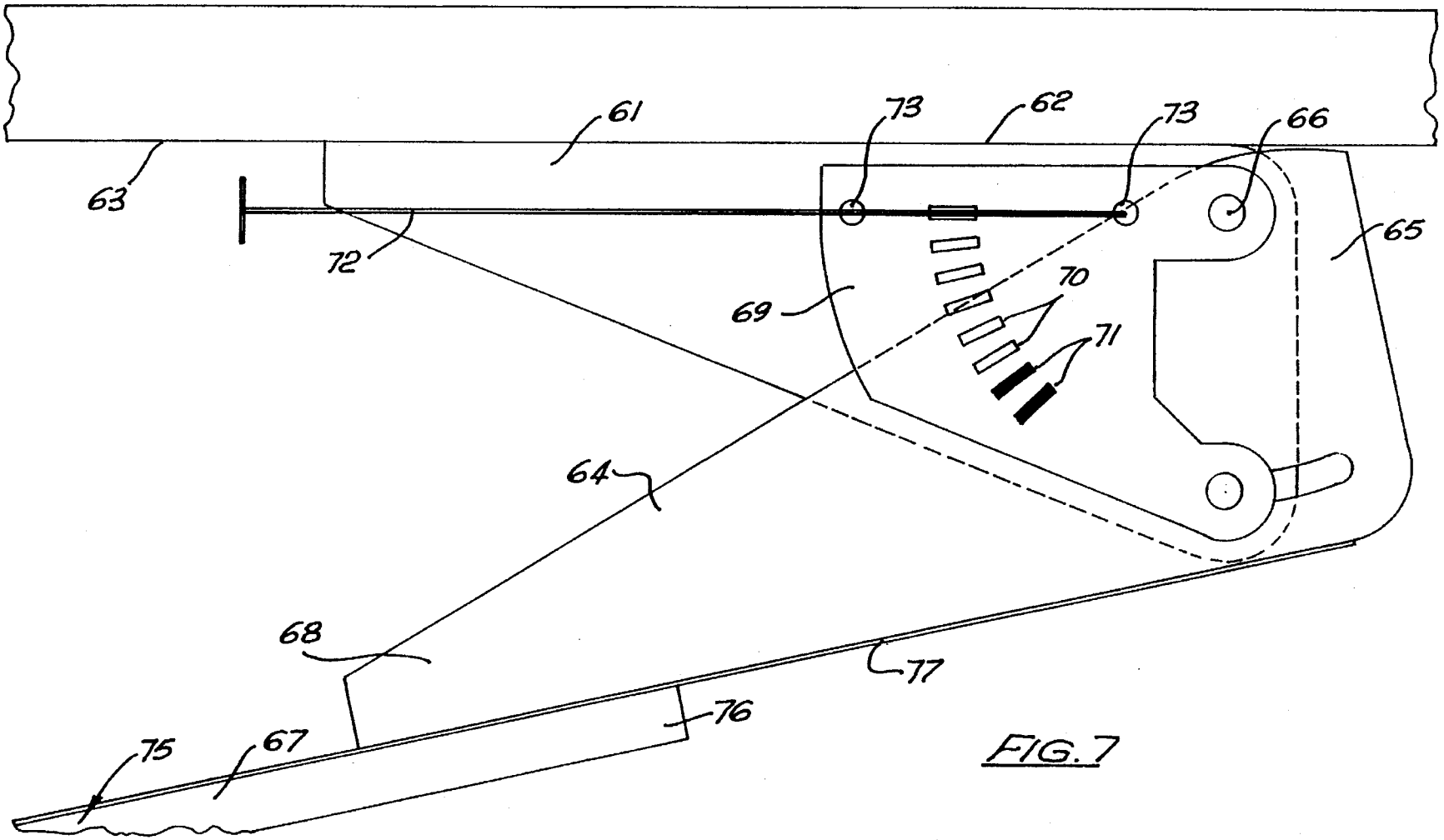
FIG. 7 is a side view of an adjustable keyboard support according to a fourth aspect of the invention shown in the lowered configuration.
Figure 8:
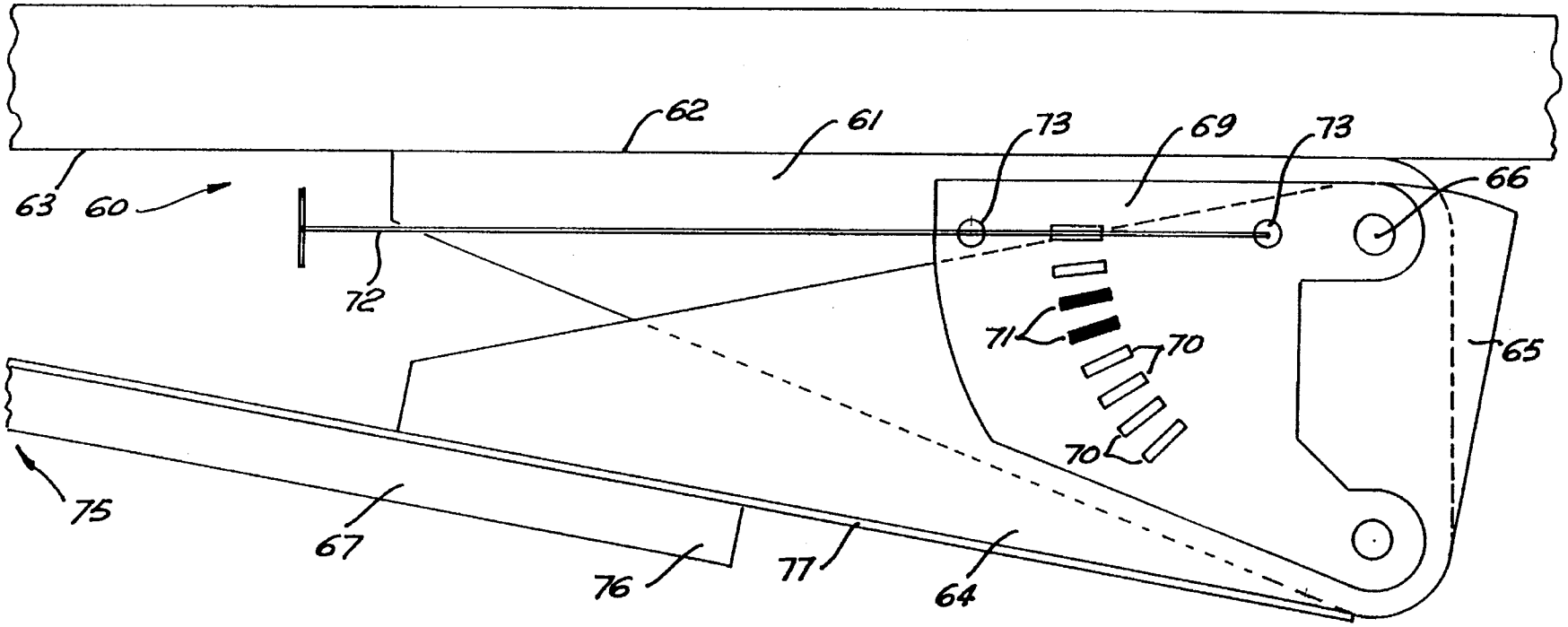
FIG. 8 is the adjustable support of FIG. 7 shown intermediate the raised and lowered configuration.

Referring to FIGS. 7 and 8, an adjustable keyboard support 60 includes two opposed generally triangular brackets 61 for mounting along edge 62 to a desk surface 63. Two linkage arms 64 are hinged at a first end 65 to respective brackets 61 by way of hinge pins 66. A keyboard support 67 extends between and is fixed to the second ends 68 of arms 64 for movement between a raised and lowered configuration. Locking means in the form of a resiliently deformable plate 69 extends between one of brackets 61 and a respective arm 64 for selectively maintaining support 67 in one of a plurality of predetermined dispositions.

Plate 69 includes a plurality of radially diverging apertures 70 spaced apart in an arcuate configuration for interengagement with two complementary formations 71 associated with one of arms 64. A handle 72 is fixedly secured to plate 69 by rivets 73 and is movable in a horizontal plane away from support 61 to resiliently deform plate 69. Once deformed, apertures 70 are moved out of engagement with formations 71 and arms 64 are free to hinge about pin 66. Consequently, support 67 is able to be moved as desired.

Support 60 is able to be directly fixed to surface 62 by way of bolts, screws or other suitable attachment means. Preferably, however, brackets 61 include flanges (not shown) extending along the length of edges 62 and at right angles to brackets 61. The flanges being formed for complementary respective engagement within channels of two parallel spaced apart tracks 2, as have been described above.

When disposed within tracks 2 an additional locking means is optionally included to selectively prevent longitudinal progression of support 60 along the tracks. Preferably this optional apparatus is an extension of the existing locking mechanism. For example, a movement of handle 72 toward support 61 could deactivate this additional lock.

Plate 69 provides a locking mechanism which is simple and light weight for facilitating the use of support 60 in conjunction with tracks 2. Moreover, support 60 includes only two linkage arms in contrast to a heavier pantographic arrangement.

As shown in FIG. 7, when in the lowered configuration support 67 extends downwardly and away from surface 63 to allow ease of access by an operator to the keyboard or other supported items. When the keyboard is not being utilised by the operator, support 60 is able to be moved such that support 67 is at least substantially disposed beneath surface 63 to enable free access to the overlying desk. Furthermore, before support 60 is so moved, it is preferable to adjust support 67 toward the raised configuration, as best illustrated in FIG. 8. As shown, support 67 is now disposed at an angle to surface 63, however, free end 75 of support 67 is now disposed closer to surface 63 than the fixed end 76. Consequently, sufficient room is provided for the operator's legs while the keyboard is stored for later use. It is no longer necessary to retract the keyboard support to such an extent that it is difficult to enable its recovery to the original position. The present support 67 is able to be easily and conveniently nested adjacent the edge of the desk without hindering the operator.

Keyboard support 67 is shown as extending substantially parallel to the side 77 of arms 64. In other embodiments support 67 is inclined with respect to side 77.

The construction of a workstation according to the invention, or the installation of mounting tracks to a conventional workstation, are easily achieved due to the independent nature of the tracks allowing accommodation for any required spacing between formations. As such, the invention is able to be used in most applications. The appropriate number of tracks are generally aligned on the surface to which they are to be fixed and spaced apart to receive respective formations extending from the adjustment mechanism. Alternatively, the tracks are mounted in slidable engagement with the formations and then secured, so that the alignment and spacing of the tracks is automatically effected.

Figure 9:
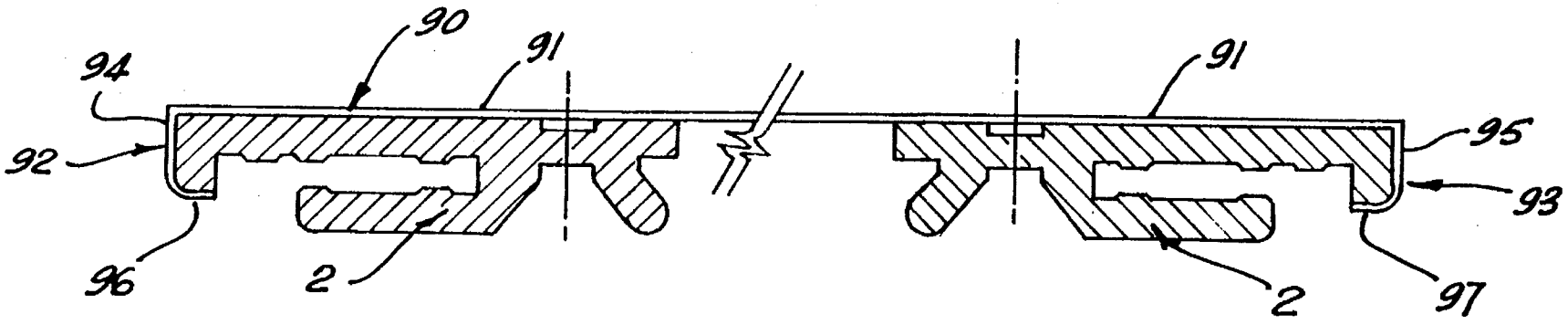
FIG. 9 is an end view of a mounting template which is nestingly receiving two of the mounting tracks of FIG. 3.

In a preferred application, tracks 2 are used in combination with a longitudinally extending mounting template 90, as shown in FIG. 9. The template includes a substantially planar central portion 91 having disposed on the transverse edges thereof respective opposed lips 92 and 93. The lips both include respective first portions 94 and 95 which extend at right angles from portion 91 and second portions 96 and 97 which extend inwardly toward each other.

Template 90 is configured for housing two opposed tracks 2 in a predetermined transversely spaced apart relationship. Lips 92 and 93 accept respective lips 18 of tracks 2 in nested engagement for providing both a predetermined relative spacing between tracks 2 and a visually appealing exterior appearance.

The template can be separately secured to the adjacent support surface, however, it is preferred that such securement is effected by screws 7 which extend through respective bodies 5 of tracks 2.

Preferably, template 90 includes an end cap (not illustrated) for visually concealing the tracks. This arrangement furthers the effectiveness of the template in preventing the inadvertent placement of objects near the moving parts of the workstation.

If required, central portion 91 of template 90 includes at least one corrugation for providing further positive location of tracks 2.

Although only workstations including pantographic mechanisms for effecting vertical longitudinal adjustment have been disclosed, the invention is adaptable for use with many other height adjustment systems. Moreover, substantially any drawer or shelf surface mounted for slidable engagement is able to be advantageously modified by the present invention.

When used in the horizontal configuration as illustrated in the preceding description, or when disposed at an angle to the horizontal tracks 2 are able to be modified to include a locking device such as described above for selectively preventing longitudinal movement of the supported structure along the tracks. Other locking devices can also be used.

Although integral locking means for the track have been described above, it will be appreciated that the use of alternative locking mechanisms are also possible. For example, a locking mechanism can selectively prevent movement between the track 2 and template 90, track 2 and flange 31, track 2 and the work surface or flange 31 and the work surface. A combination of these arrangements are also possible. Additionally, in some embodiments the height adjustment mechanism incorporates the locking means therein.

Although the invention has been described with reference to specific examples, it will be appreciated by those skilled in the art that the invention may be embodied in many other forms.

I claim:

1. A workstation including:

two generally horizontal support members;

a linkage mechanism for maintaining a predetermined vertical displacement between the members;

the mechanism being fixed at one end to one of the members and at the other end including at least one longitudinally extending support formation; and at least one mounting track for connecting the other support member and the support formation for relative longitudinal movement, the track including a longitudinally extending body for abutting the said other of the support members and first and second transverse arms extending from the body and having respective opposed substantially parallel first and second engagement surfaces which, in combination with the body, define an open ended channel for retaining the support formation, the free end of the first arm both extending beyond the free end of the second arm and including a peripherally depending lip for partly closing the channel to restrain transverse movement of the support formation. for longitudinal slideable engagement therewith.

2. A workstation according to claim 1 wherein the mechanism is adjustable for allowing relative vertical movement between the members.

3. A workstation according to claim 1 wherein the mechanism includes a locking device for selectively maintaining the mechanism in one of a plurality of configurations.

4. A workstation according to claim 1 and including a longitudinally extending mounting template disposed between said tracks and said other support surface, wherein said template includes at least one locating formation for maintaining said tracks in a fixed relationship.

5. A workstation according to claim 1 including locking means for selectively positively locating said support members with respect to each other.

6. A workstation according to claim 5 wherein said locking means locates said members insofar as relative longitudinal displacement is concerned.

7. A workstation according to claim 6 wherein said locking means is associated with said linkage mechanism.

8. A workstation according to claim 6 wherein said locking means includes a plurality of spaced apart tabs formed in one of said first or second arms, said tabs each including a respective locking protrusion for engaging a complementary detent or aperture in said support formation.

9. A workstation according to claim 1 wherein at least one of the first and second engagement surfaces includes a plurality of engagement formations for facilitating slidable progression of the support formation along that engagement surface.

10. A workstation according to claim 9 wherein the engagement formations are longitudinally extending transversely spaced apart ridges.

11. A workstation according to claim 9 wherein the engagement formations are longitudinally extending transversely spaced apart ridges.

12. A work station according to any one of claims 1, 9, 10, or 11 wherein the lip extends substantially perpendicularly to the plane of the second engagement surface and defines a third engagement surface extending from the first engagement surface.

13. A workstation according to any one of claims 1, 9, 10, 11, or 12 wherein said body is fixedly attached to said first structure at a plurality of longitudinally spaced apart attachment sites.

14. A workstation according to claim 13 wherein each of said attachment sites are defined by an aperture in said body which is formed for complementary engagement with fixing means.

15. A workstation according to claim 14 wherein said fixing means includes a bevel headed screw disposed adjacent said channel for providing support for said second arm.

16. A workstation including:

a first and a second generally horizontal support members, the first member including at least one longitudinally extending support formation;

a linkage mechanism for maintaining a predetermined vertical displacement between the members, the mechanism being fixed at one end to the second member and at the other end including at least one longitudinally extending mounting track for connecting the mechanism to the support formation for relative longitudinal movement, the track including a longitudinally extending body for abutting the linkage mechanism and first and second transverse arms extending from the body and having respective opposed substantially parallel first and second engagement surfaces which, in combination with the body, define an open ended channel for retaining the support formation, the free end of the first arm both extending beyond the free end of the second arm and including a peripherally depending lip for partly closing the channel to restrain transverse movement of the support formation.

* * * * *

UNITED STATES PATENT AND TRADEMARK OFFICE

CERTIFICATE OF CORRECTION

PATENT NO. : 5,588,375

DATED : December 31, 1996

INVENTOR(S) : Michael J. Cotterill

It is certified that error appears in the above-indentified patent and that said Letters Patent is hereby corrected as shown below:

Column 2, lines 3-4, delete "wherein the support formation bears on one of said first and second engagement surfaces,".

Column 3, lines 26-41, delete the entire paragraph.

Column 3, line 66, after "workstation" insert -- 1 --.

Column 9, claim 1, lines 23-24, delete "formation. for longitudinal slideable engagement therewith" and insert -- formations. --

Signed and Sealed this

Twenty-third Day of September, 1997

Bruce Lehman

*Attest:*

BRUCE LEHMAN

*Attesting Officer*

*Commissioner of Patents and Trademarks*